United States Patent [19]

Ulinskas

[11] Patent Number: 4,501,270

[45] Date of Patent: Feb. 26, 1985

[54] BREATHING AIR CONSERVATION SYSTEM

[75] Inventor: Gary J. Ulinskas, La Jolla, Calif.

[73] Assignee: Whittaker Corporation, Los Angeles, Calif.

[21] Appl. No.: 437,187

[22] Filed: Oct. 27, 1982

[51] Int. Cl.[3] ..... A62B 7/00

[52] U.S. Cl. ..... 128/202.13; 128/205.24; 123/198 E

[58] Field of Search ..... 128/202.14, 205.26, 128/204.18; 123/198 E, 564, 559; 114/337

[56] References Cited

U.S. PATENT DOCUMENTS

| | | | |
|---|---|---|---|
| 1,114,126 | 10/1914 | Drager | 137/597 |
| 1,704,082 | 3/1929 | Goode | 123/564 |
| 3,367,315 | 2/1968 | Whittle | 114/337 |
| 4,181,126 | 1/1980 | Hendry | 128/201.21 |
| 4,362,154 | 12/1982 | Se Masson | 128/204.22 |

FOREIGN PATENT DOCUMENTS

| | | | |
|---|---|---|---|
| 372391 | 3/1923 | Fed. Rep. of Germany | 123/198 E |
| 523232 | 4/1921 | France | 123/564 |

*Primary Examiner*—Henry J. Recla

*Attorney, Agent, or Firm*—Henry M. Bissell

[57] ABSTRACT

An enclosed survival capsule having an automatic allocation system for providing breathing air for its occupants and intake air sufficient to operate a propulsion engine satisfactorily under emergency operating conditions. Air from a compressed air source on board the capsule is allocated between the engine and the crew breathing system. Air exhaled into the cabin by the crew is available through a restricted orifice to provide part of the intake air for the engine. A relief valve on the breathing air portion of the system is operative to insure that sufficient air is available from the cabin to enable the engine to operate at minimal air consumption levels commensurate with power requirements.

19 Claims, 2 Drawing Figures

BREATHING AIR CONSERVATION SYSTEM

BACKGROUND OF THE INVENTION

1. Field of the Invention

This invention relates to air intake control systems for diesel engines or the like and, more particularly, to such systems utilized in survival capsules and which draw air from an onboard compressed air source.

2. Description of the Prior Art

The present invention is particularly adapted for use with diesel engines installed in enclosed lifesaving vessels known as survival capsules. Such vessels have been developed as an improvement over conventional lifeboats and are particularly designed for installation and use on offshore oil well drilling platforms.

Survival capsules as presently designed are sturdy, self-propelled vessels, totally enclosed with hatches or ports for ingress and egress. These hatches can be closed and sealed against the inlet of water; and the vessel has a self-righting capability so that it can recover from a complete roll-over, as may happen in heavy seas, and still operate to carry its passengers to safety. These vessels are presently sized in ranges from 30- to 50-man capacities. Typically, the survival capsules are stored at a level just below the main deck of a well-drilling platform; and the associated survival system includes a single cable, releasable hook, and powered winch for lowering the capsule to the water and releasing it under circumstances where the need for rescue from, or abandonment of, the platform may arise.

In the environment in which survival capsules are designed for principal use, situations can develop where the capsule should be capable of operating in a flammable gas or liquid environment or, indeed, must be able to propel itself through seas covered with burning fuel. Such a situation can arise in an oil well platform disaster resulting in spillage of oil into the ocean with the possibility or existence of fire over an extended surface area. If the disaster is such that the platform must be abandoned, the capsule should have the capability of protecting its occupants from the flames on the ocean surface while propelling itself to a safe area. Systems have been developed for dealing with this problem wherein compressed air bottles are stored in the vessel for providing fresh air within the vessel at a slight positive pressure when all hatches and ports are sealed. Thus, the flames and/or noxious and possibly flammable gases in the environment surrounding the vessel are prevented from entering the capsule to the jeopardy of its occupants. A problem, however, with this system arises from the fact that the diesel engine constituting the propulsion means for the capsule draws its intake air from the interior of the capsule, thus competing with the occupants of the capsule for the use of this compressed air in sustaining life.

Diesel engines such as are employed in survival capsules of the type described have the capability of continuing to operate and develop sufficient power, even though partially starved for intake air needed for internal combustion in the engine. Although power output is degraded under such conditions, the engine is still capable of developing the power needed to drive the capsule at required speed where the intake air is temporarily restricted down to only a portion of the air normally drawn into the engine under unrestricted operating conditions.

Even greater efficiencies, however, in the allocation of the air supply to the crew and the engine are desired when breathing masks are to be employed and particularly in view of the possibility that hydrogen sulfide (H2S), an extremely poisonous gas, may be released during the drilling process.

H2S can kill humans at low concentrations (at 500 parts per million, death comes in a few minutes) and affects diesel engine performance adversely at higher concentrations (for example, at 5000 parts per million a diesel engine may begin to misfire, race, or otherwise malfunction).

Lifeboats for use in certain areas where hydrogen sulfide gas may be released from a well during the drilling process are required to carry emergency air for both the occupants of the lifeboat and for the engine which powers the lifeboat. Since diesel engines are much less sensitive to H2S than humans, and space which can be allocated to the onboard air supply is limited, it would be desirable if a technique could be devised for enabling the engine to supplement its own dedicated air supply with air exhaled by the occupants of the lifeboat.

SUMMARY OF THE INVENTION

In my prior copending application Ser. No. 266,641, now U.S. Pat. No. 4,444,163 filed May 26, 1981 and entitled AIR METERING SYSTEM FOR DIESEL ENGINE, I disclose a system for limiting the air intake to a diesel engine for a survival capsule to a minimum level at which the diesel engine can operate satisfactorily. That system is designed for use where the engine must be operated totally from an onboard air supply in a closed vehicle. The disclosure of that patent application is incorporated herein by reference as though set forth in haec verba.

Arrangements in accordance with the present invention incorporate the intake control mechanism of that application and make provision for the efficient utilization of that system in conjunction with a system of bottled air and breathing masks for the occupants of the capsule so that both the occupants and the diesel engine are enabled to make most efficient use of the onboard air supply when encountering a poisonous gas atmosphere.

The air exhaled from the breathing masks of the crew members (still reasonably rich in oxygen content) is available to the air intake system of the diesel engine in the manner described in my aforementioned patent application. To this system I have added a relief valve in the compressed air system feeding the breathing masks for the crew members onboard the capsule to ensure that a certain minimum amount of air is released into the cabin for directing to the engine through the intake system. This relief valve closes when a predetermined number of crew members are breathing from the compressed air system, that number being sufficient to provide the additional air needed by the engine from the air exhaled by the crew. The selected relief pressure setting is dependent upon the make and model of the regulator used in the crew breathing masks.

Each crew member in the capsule wears a breathing mask which is connected to the bottled air system of the capsule. The crew members use approximately 1.2 to 2.0 cubic feet of air per minute, depending upon the physical condition of the crew, the state of excitement or exhaustion, the breathing rate, etc. Each crew member breathes in air from the compressed air supply through a breathing mask and exhales used air which enters the cabin of the capsule. This exhaled air is now available for use by the engine.

A diesel engine has a certain air consumption at a particular power rating. For example, if an engine utilizes 80 cubic feet of air per minute, the exhaled air of 50 people will supply a minimum of 60 cubic feet (50×1.2 cubic feet of air per person) and a maximum of 100 cubic feet (50×2.0 cubic feet of air per person), thus contributing substantially to the total air needs of the engine if suitable arrangements can be devised to accommodate the engine air requirement under variable operating conditions.

There may be situations in which exhaled breathing air is less than that required by the engine. This can be caused by (1) the crew breathing at the minimum rate or (2) less than a full crew on board the capsule. In arrangements of the present invention, a certain portion of the total bottled air supply stored in the capsule is dedicated for use by the engine (typically two of the six air bottles on board). Sufficient additional air for the needs of both the engine and the crew is provided with maximum efficiency and safety being afforded to the limit of the air supply on board the capsule.

The air relief valve in systems of the present invention releases air to the cabin when breathing air consumption is low because only a few crew members are utilizing the system. As more members of the crew hook up to the breathing system, causing the air delivery line pressure to drop, the relief valve closes, saving the bottled air for crew use. During the time that both exhaled air and air expended from the relief valve are entering the cabin, any concentration of hydrogen sulfide (H2S) which may have entered the capsule during the boarding process is diluted. The invention thus is very significant in those situations wherein H2S or other poisonous gas is present when the capsule is being used for life saving.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
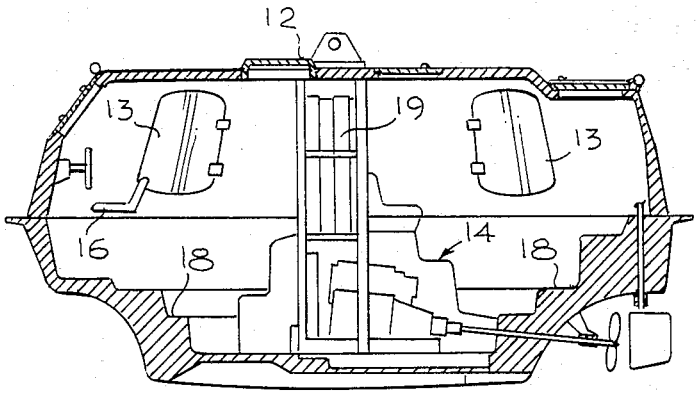
FIG. 1 is a sectional elevation diagram illustrating a capsule which incorporates the breathing air conservation system of the invention.

FIG. 1 illustrates, in a sectioned elevation view, the salient details of a survival capsule in which the present invention may be incorporated. In FIG. 1, the capsule 10 is shown having an outer support member by which the capsule may be suspended from a cable and lowered from a well drilling platform for escape of the crew members under hazardous conditions, such as a fire on the platform, collapse of the platform, and other hazardous conditions. The capsule includes watertight doors 13, an engine box 14, seating accommodations 16, 18 and a storage area 19 for the bottles of compressed air to provide breathing air for the crew and intake air for the engine.

Figure 2:
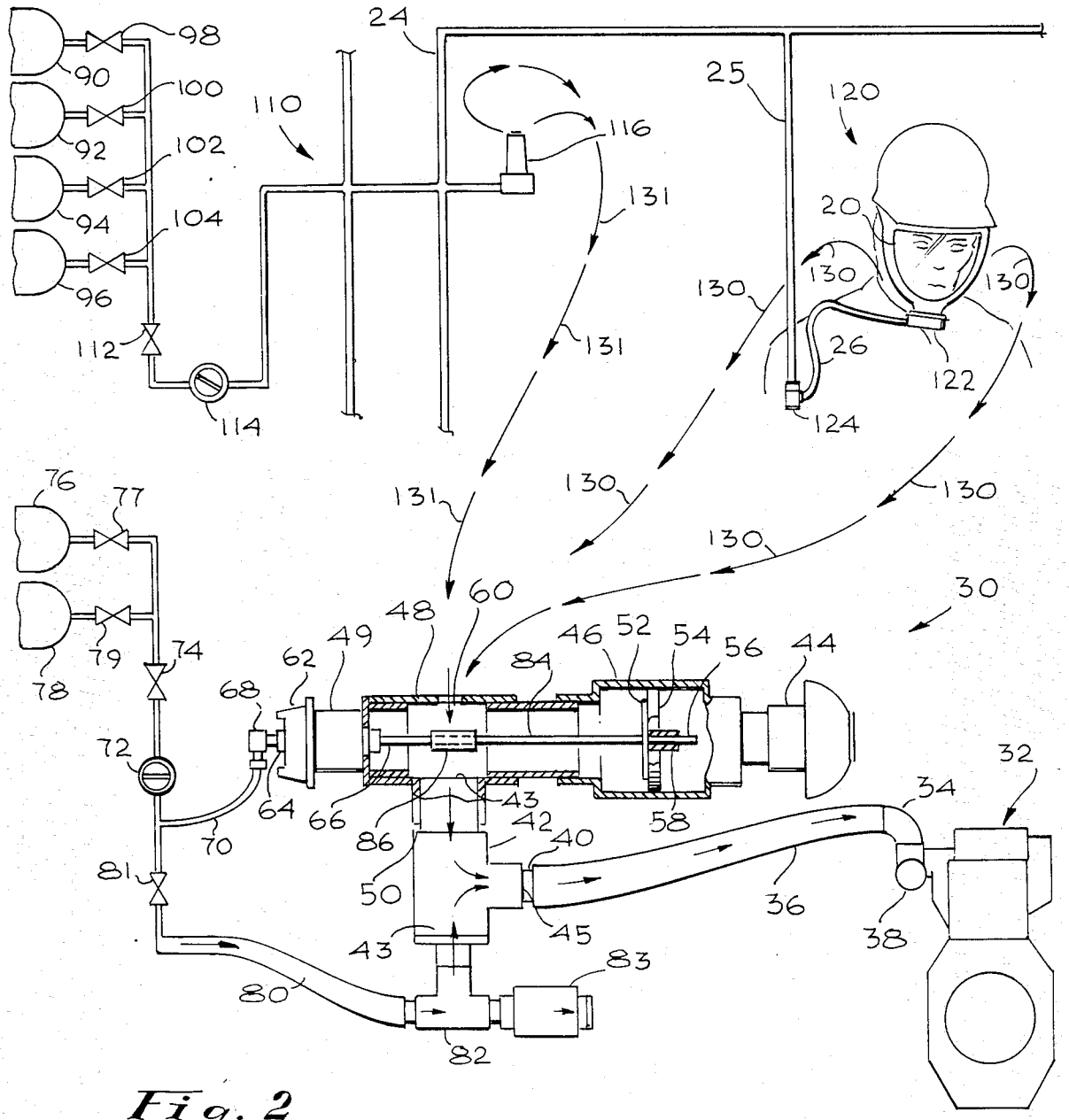
FIG. 2 is a schematic diagram illustrating the details of the present invention.

As is indicated in more detail in FIG. 2, adjacent each seating position 16, 18, is a breathing mask, such as 20, which is a conventional full face mask of the type commonly used by firemen in conjunction with portable air packs.

Positioned within the capsule cabin is a manifold 24 (see FIG. 2) which carries the compressed bottled air via connector 25 to the mask of each user via tubing 26. In a typical arrangement, four air bottles are allocated for the crew and the cabin space while two bottles are allocated for the engine. A relief valve (shown in FIG. 2) is coupled to the bottles allocated for the crew and is set at a predetermined pressure level, governed by the type of regulator in the crew breathing masks, so that the relief valve vents air to the cabin area when less than a predetermined number of crew members (typically 20) are hooked up to the system. When more than 20 crew members are hooked up to the system, the system line pressure drops and the relief valve closes, thus preventing any further air from the four air bottles allocated to the crew from venting to the cabin. It should be noted that standard fittings are provided to allow the breathing masks to hook up to the system.

As is more particularly shown in FIG. 2, an air intake control system 30, very similar to the system disclosed in my aforementioned application Ser. No. 266,641, assigned to the assignee of the present invention, is coupled to the intake manifold of an internal combustion engine 32 by conventional means such as an elbow 34, hose 36, hose clamp 38, fitting 40 and manifold 42. Manifold 42 has two air intake passages 43 and an air outlet passage 45. The system 30 comprises an intake port 44 coupled to valve chamber 46 which in turn is coupled to a tee junction section 48. At the opposite end of the crossbar portion of the tee junction section from the valve chamber 46, there is mounted a fluid pressure responsive actuator 49. The leg portion of the tee junction comprises a further coupling 50 which extends into the manifold 42.

The valve chamber 46 includes a valve 52 mounted on a transverse wall member 54 by a valve stem 56 which is slidably received and supported by a centrally located valve support member 58. A plurality of openings (not shown) in the transverse wall member 54 permit intake air to flow from the intake port 44 to the interior of the intake passage within the tee junction 48 subject to control by the valve 52. The valve 52 may be pulled away from the wall member 54 to permit intake air to flow through the openings when the engine is operating, by virtue of the vacuum developed in the intake passage. Intake air is also permitted to enter the intake passage through an inlet orifice 60 open to the capsule cabin in a wall portion of the tee junction 48. Thus, air from the cabin for the internal combustion engine 32 is received through the standard air intake 44 when the valve 52 is opened, but is restricted to air entering through the orifice 60 when the valve 52 is held closed.

The actuator 49 includes a diaphragm cap 62 including an internal diaphragm and piston member which are responsive to fluid pressure applied to the internal diaphragm via an inlet 64. The actuator further includes an actuator rod 66 which is extended by the internal diaphragm and piston when the actuator head 62 is pressurized. An internal spring causes the rod 66 to retract when the head is depressurized.

An adaptor 68 is coupled to the actuator inlet 64 and is coupled to a pressure hose 7 which in turn is coupled to the line from a regulator 72. The regulator 72 is mounted on the downstream side of a main control valve 74 which is coupled to the manifold from compressed air storage bottles 76 and 78. Valves 77 and 79 are provided to permit removal of an individual bottle and are left open when the filled bottles are in position. When the main valve 74 is opened, which would occur when an emergency situation arises, compressed air from the compressed air bottles is directed to the regulator 72, regulated at a pressure slightly above sea level ambient so as to develop a slight positive pressure within the capsule, and released into the inlet of manifold 43 via hose 80 and tee section 82 and thence to engine 32 via outlet passage 45 of manifold 42.

An extension rod 84 is shown coupled to the actuator rod 66 by means of a coupler 86. The extension rod 84 is provided with a head at its distal end for bearing against the valve 52 when the actuator rod 66 is fully extended.

The valve 81 in the line 80 is adjusted at the factory to provide a limited flow of air from the bottles 76, 78 to the engine. This setting of the valve 81 is adjusted to permit air flow at a rate which satisfies the engine need when combined with air through the orifice 60 and the valve is then wired in a fixed position at that setting. Instead of the valve 81, a suitable fixed orifice element could be used, matching the fixed orifice setting of the valve 81. At the second outlet of the tee 82, a check valve 83 is provided to vent the air in the line 80 to atmosphere within the cabin in the event that the main valve 74 is opened before the engine 32 is started. Once the engine 32 is running, the intake manifold system develops a positive vacuum which keeps the check valve 83 closed.

The intake manifold system 30 just described is effective, under emergency operating conditions, to supply the minimum air requirement of the engine 32, thus enabling the engine to operate satisfactorily, albeit with somewhat reduced power and rpm because of the over-rich fuel-to-air ratio in the cylinders. The sizes of the fixed orifices 60 and 81 are positioned so that the air from the bottles 76, 78 supplies about 65% of the air to the engine under these operating conditions, the remainder entering through the orifice 60. The air entering through the orifice 60 is drawn from the cabin to which it is supplied from the portion of the compressed air supply system which provides breathing air to the crew members.

Supplying breathing air to the crew under emergency conditions is accomplished as follows. Four bottles of compressed air 90, 92, 94 and 96, having associated connector valves 98, 100, 102 and 104, respectively, are coupled to the piping manifold system, represented by numeral 110, via main valve 112 and regulator 114. A relief valve 116 is coupled to the manifold 110 to provide additional air for use by the engine 32 as drawn from the cabin through the orifice 60. The regulator 114 is set for a flow rate which permits the relief valve 116 to provide the remaining 35% of air needed by the engine. The relief valve 116 is set at a predetermined pressure compatible with the particular breathing mask regulators which are employed and is effective to discharge air into the capsule cabin when the pressure in piping system 110 remains at or above this level, corresponding to the situation when fewer than 20 to 30 crew masks are plugged into the breathing air manifold system. The pressure in the manifold 110 decreases as additional crew masks are plugged into line 110 and, when approximately 20–30 crew members plug in, relief valve 116 closes and no further air is discharged through that valve into the cabin, the remaining air in bottles 90, 92, 94 and 96 being reserved for the crew who now provide sufficient exhaled air to supply the portion required by the engine 32 through restricted port 60.

FIG. 2 also shows for illustrative purposes a single crew member 120 having face mask 20 in place. The air intake 122 associated with face mask 20 is coupled to a quick connect coupling 124 on the individual line 25 via hose 26, thus connecting crew member 120 to the air manifold 110.

In operation, so long as the capsule 10 in which the system 30 and engine 32 are mounted is being driven under normal conditions with hatches on the outside being at least partially open to permit the free flow of air from the ambient atmosphere outside the capsule for combustion air for the engine and breathing air for the crew, air is admitted to the engine via conventional intake 44. However, should the capsule be operated in an environment where flames or flammable gases or poisonous gases, such as H2S, are present, the crew will then close the hatches and all other inlet ports to the lifeboat and will open the two main valves 74 and 112 to provide compressed air from the air cylinders to the engine system 30 directly and to the cabin air/breathing system manifold 110. As set forth hereinabove, in the arrangement shown, air bottles 76 and 78 are allocated to supply compressed air to the engine 32. During emergency operation, the intake port 44 is closed and the intake manifold vacuum in the engine 32 pulls air from the cabin through orifice 60 into the engine manifold. Simultaneously, additional air is being supplied to engine 32 from bottles 76 and 78. Typically, each crewman in the lifeboat wears a breathing mask which is connected to the bottled air system of the lifeboat as set forth hereinabove. The crew uses approximately 1.2 to 2.0 cubic feet of air per minute, depending on the physical traits of the crew and the state of excitement or exhaustion. The crew breathes in air from the bottled supply and exhales used air from the mask which enters the cabin of the capsule. It is this exhaled air, represented by reference arrows 130, which is available for the engine 32 via orifice 60.

Diesel engines in general have a certain air consumption requirement at a particular power rating. If, for example, the engine 32 uses 80 cubic feet of air per minute, the exhaled air of 50 people will typically supply a minimum of 60 cubic feet and a maximum of 100 cubic feet per minute. Since there are situations in which exhaled breathing air is less than that required by the engine, such as when the crew breathes at the minimum rate or there is less than the full capacity of the capsule on board, the remaining air needed from the cabin by the engine 32 is provided via the relief valve 116 (represented by the arrows 131). The combination of the regulator 114 and the relief valve 116 results in the relief valve being closed when there are enough crew members breathing from the manifold system 110 to supply the 35% of the air needed by the engine through orifice 60. At any time that the air breathed by the crew members drops below that level, so that the pressure in the manifold system 110 increases above the setting of the relief valve 116, the relief valve 116 will again open to ensure that sufficient air is supplied to the cabin for engine operation as described. Thus, the sizing of the fixed orifices 60, 81 and the settings of the relief valve and the two regulators 72, 114 act in combination to provide the desired operation, automatically providing sufficient air to operate the engine 32 while permitting part of this air to be supplied by the breathing of the members on board the capsule.

A unique feature of the present invention is that during the time that the exhaled air and the air expended from the relief valve 116 are entering the capsule cabin, any concentration of H2S which may have entered the capsule during the boarding process is constantly being diluted, thus improving the quality of the air for the engine.

A system has thus been devised and is herein disclosed which provides increased safety and endurance for the operation of an enclosed lifesaving vessel, such as a survival capsule or the like, in operating through hazardous outside atmosphere with increased protection to the occupants. The system operates to reduce the amount of onboard compressed air needed to be directly coupled to the propulsion engine by using exhaled air to make up a portion of the air required to drive the engine, thus providing the necessary cabin air for a longer period of time than has hitherto been the case. The enclosed system also operates automatically to restore the air intake system to normal operation when the operating crew shuts off the main valves or when the bottles providing compressed air directly to the engine are exhausted.

Although there has been described above one specific arrangement of a breathing air conservation system for use on survival capsules in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A selectively controllable air intake system for a diesel engine or the like for controlling air supplied to the engine during a restricted air supply operation comprising:

a housing for coupling to an engine air intake which is mounted for operation within a generally enclosed space, the housing defining an air intake passage including an inlet port which is located within the generally enclosed space;

a valve mounted within the passage for restricting the air admitted through the inlet port;

means for pressurizing the enclosed space to a level above ambient atmosphere pressure;

pressure responsive actuator means coupled to said valve for controlling the valve to close the air intake passage from the inlet port;

means downstream of the valve for admitting air to the air intake passage in a first limited amount bypassing said valve;

means coupled to said housing and having first and second inlet passsages and an outlet passage said first inlet passage being coupled to the air intake passage downstream of the valve to receive air therefrom; and means coupled to the second inlet passage for supplying compressed air to said second inlet passage in a second limited amount; said actuator means being responsive to pressure supplied to said second inlet passage for controlling said valve;

said outlet passage being adapted for coupling the housing to the engine air intake for directing air from the first and second inlet passages to the engine to enable the engine to operate at a restricted power level.

2. The system of claim 1 wherein the valve is mounted within the air intake passage adjacent the inlet port and is operative between open and closed positions.

3. The system of claim 2 wherein the pressure responsive means is effective, when actuated, to drive the valve to the closed position.

4. The system of claim 2 wherein the housing comprises a first orifice adapted to communicate with the enclosed space and the means for supplying compressed air includes a restrictor means in series with the second inlet passage, the sizes of the first orifice and restrictor means being selected in relation to the engine to produce a total of said first and second limited amounts of air sufficient to satisfy the minimum air needed by the engine during restricted air supply operation.

5. The system of claim 4 wherein the first orifice is sized to provide about 35% and the restrictor means is sized to provide about 65% of the air supplied to the engine in the restricted air supply mode of operation.

6. The system of claim 4 wherein the restrictor means is preset to limit air flow from the compressed air supply to a rate which, when combined with air from the first orifice, is sufficient to operate the engine in the restricted air supply mode.

7. The system of claim 1 wherein the enclosed space comprises an enclosed lifesaving vessel and the pressurizing means comprises a breathing air system for occupants of the vessel.

8. The system of claim 7 wherein the breathing air system includes a plurality of compressed air cylinders, a manifold system connected to said cylinders valving means and first pressure regulator means for controlling the flow of air from the compressed air cylinders to the manifold system, and a plurality of breathing masks selectively connected to the manifold system, whereby air from the breathing air system, after being breathed by occupants of the vessel via the breathing masks, is released into the enclosed space for inclusion in the air admitted through the first orifice.

9. The system of claim 8 further including a relief valve coupled to the manifold system for releasing air from the breathing air system directly into the cabin for inclusion in the air admitted by the admitting means in accordance with the demand of the engine.

10. The system of claim 9 wherein the first regulator means and the relief valve are adjusted to cause the relief valve to close when the pressure in the manifold system falls below a predetermined level due to demand by occupants of the vessel breathing through the breathing masks.

11. The system of claim 10 wherein said predetermined level is selected in accordance with the make and model of the breathing masks utilized and the first regulating means is adjusted to enable the relief valve, when opened, to provide approximately 35% of the air required by the engine during restricted air supply operation.

12. The system of claim 8 wherein the first pressure regulator is set to develop a pressure level in the manifold system to cause the relief valve to close when the air being breathed by the occupants of the vessel accounts for approximately 35% of the air needed by the engine for restricted power operation.

13. The system of claim 1 further including a check valve coupled to the compressed air supplying means for releasing compressed air into the enclosed space outside of said housing upon the buildup of pressure within the housing.

14. The system of claim 13 wherein the check valve is operative to assume a closed position in the event of a vacuum being developed within the housing due to the operation of the engine.

15. A combination system for an enclosed survival capsule for supplying air during a restricted air intake mode to the occupants in the cabin of the capsule and air for an engine constituting the propulsion means of the capsule, said system comprising:

(1) an air intake control system having a housing including an air intake passage adapted to be coupled to the engine air intake, said housing having an intake port adapted to be located in communication with the cabin atmosphere to provide air to the engine to enable the engine to operate in a normal air intake mode, said air intake control system further including:

(a) pressure responsive means for closing said air intake port;

(b) a first orifice in said housing adapted to be located in communication with said cabin atmosphere and downstream from the closing means for admitting air into the air intake passage from the cabin and bypassing the air intake port; and (c) means for supplying air from a compressed air source to the air intake passage and including a restrictor means in series with the air supplying means for limiting the air provided from the compressed air source to said intake air passage, said first orifice and restrictor means being respectively sized to provide about 35% of the air to the engine through the first orifice from the cabin and about 65% of the air to the engine from the compressed air source when the engine is operating in the restricted air intake mode said pressure responsive means closing said air intake port in response to air supplied to said air intake passage from said compressed air source said compressed air source; and (2) a breathing air supply system adapted to be mounted in said capsule including:

(a) a compressed air supply;

(b) a breathing air manifold connected to said compressed air supply and having a plurality of breathing masks selectively connected thereto; and (c) a main valve and a regulator connected in series between the compressed air supply and the manifold, the regulator being set to provide a flow rate corresponding to the 35% of engine air drawn in through the first orifice;

whereby air exhaled by users of the breathing air system is exhausted into the cabin and is thereby available to supply air admitted through the first orifice.

16. The system of claim 15 further including an air relief valve coupled to the manifold and adapted to discharge air to the cabin when the exhaled air is less than the 35% of engine air needed through the first orifice.

17. The system of claim 16 wherein the air relief valve is provided with a pressure setting selected to release air to the cabin when the exhaled air is insufficient to supply the 35% of engie air.

18. The system of claim 16 wherein said air relief valve is prevented from discharging air to the cabin when the pressure in the manifold is below said selected pressure setting.

19. The system of claim 18 wherein the regulator is adapted to reduce the pressure in the manifold as additional breathing masks are connected to the manifold.

* * * * *